US009732517B1

(12) United States Patent
Huang

(10) Patent No.: US 9,732,517 B1
(45) Date of Patent: Aug. 15, 2017

(54) EARTHQUAKE RESISTANT AND REINFORCING DEVICE FOR BUILDINGS AND BRIDGES

(71) Applicant: Chun-Hao Huang, Kaohsiung (TW)

(72) Inventor: Chun-Hao Huang, Kaohsiung (TW)

( * ) Notice: Subject to any disclaimer, the term of this patent is extended or adjusted under 35 U.S.C. 154(b) by 0 days.

(21) Appl. No.: 15/173,992

(22) Filed: Jun. 6, 2016

(51) Int. Cl.
*E04B 1/98* (2006.01)
*E04H 9/02* (2006.01)
*E01D 19/00* (2006.01)
*E01D 22/00* (2006.01)

(52) U.S. Cl.
CPC ..... *E04B 1/985* (2013.01); *E01D 19/00* (2013.01); *E01D 22/00* (2013.01); *E04H 9/021* (2013.01); *E04H 9/024* (2013.01)

(58) Field of Classification Search
CPC ..... E04B 1/985; E04H 9/021; E04H 9/024; E01D 22/00; E01D 19/00
USPC ..... 52/167.2, 167.8
See application file for complete search history.

(56) References Cited

U.S. PATENT DOCUMENTS 3,726,986 A * 4/1973 Higaki ..... H02B 1/54 174/43
3,794,277 A * 2/1974 Smedley ..... F16F 7/127 174/161 R
3,889,937 A * 6/1975 Statler ..... F16F 7/09 267/202
4,526,047 A * 7/1985 Yang ..... F41A 25/10 188/129
5,497,858 A * 3/1996 Cloud ..... G21D 1/02 188/67
6,121,888 A * 9/2000 Bognar ..... G01V 1/008 340/540
9,504,211 B2 * 11/2016 Venton-Walters ..... A01G 25/09
2001/0033232 A1 * 10/2001 Chen ..... G08B 21/10 340/690
2005/0274084 A1 * 12/2005 Lin ..... E01D 19/00 52/167.1
2006/0272837 A1 * 12/2006 Steffen ..... E02D 3/068 173/162.2
2008/0250731 A1 * 10/2008 Wheeler ..... E04B 9/18 52/167.1
2010/0011681 A1 * 1/2010 Chiang ..... E04H 9/02 52/167.2
2011/0088919 A1 * 4/2011 Kim ..... F23D 3/18 169/65
2016/0237711 A1 * 8/2016 Powell ..... E04H 9/021

* cited by examiner

*Primary Examiner* — Brian Glessner
*Assistant Examiner* — Joshua Ihezie
(74) *Attorney, Agent, or Firm* — Rosenberg, Klein & Lee

(57) ABSTRACT

An earthquake resistant and reinforcing device for buildings and bridges is provided. In this device, two support mandrels are disposed on two ends of a main tube, and one ends of the two support mandrels are inserted in to the main tube. Baffle plates are disposed near the ends of the two support mandrels in the main tube, and sheath covers are disposed at the ends of the two support mandrels outside the main tube. A first elastic part is disposed in the main tube and between the baffle plates of the two support mandrels. A second and a third elastic parts are respectively disposed between the baffle plates of the support mandrels and the sheath covers. This device can be installed between beams and columns of buildings and bridges for effectively absorbing the energy waves acting thereon and thus increase the safety of the buildings and bridges.

10 Claims, 8 Drawing Sheets

EARTHQUAKE RESISTANT AND REINFORCING DEVICE FOR BUILDINGS AND BRIDGES

BACKGROUND

Field of Invention

The disclosure relates to an earthquake resistant and reinforcing device for buildings and bridges. More particularly, the disclosure relates to an earthquake resistant and reinforcing device that can effectively absorb and eliminate energy waves acting on beams and columns of buildings and bridges.

Description of Related Art

Countries located in the earthquake zone often encounter earthquakes, a strong natural force. Therefore, the buildings and bridges often suffer damages. In practice, it is discovered that the damage parts of buildings and bridges are usually located on thes between beams and columns to cause the structural strength decrease problem of buildings and bridges. Therefore, if the structural strength of beams and columns can be reinforced, the safety of buildings and bridges in earthquakes can be increased.

SUMMARY

In this disclosure, an earthquake resistant and reinforcing device for buildings and bridges is provided. This device may be assembled and installed between beams and columns of buildings and bridges to effectively absorb and thus eliminate the energy waves acting on the beams and columns.

The earthquake resistant and reinforcing device for buildings and bridges, comprising:

a main tube having a tubular hole penetrating the central of the main tube;

two support mandrels each having a baffle plate disposed at one end of the support mandrel in the tubular hole of the main tube and an assembling part on another end of the support mandrel outside the main tube, wherein a space is disposed between the two support mandrels;

two sheath covers each having a main tube sheath hole corresponding to a diameter of the main tube and a support mandrel sheath hole corresponding to a diameter of the support mandrels, so that the main tube sheath holes sleeve two ends of the main tube and the support mandrel sheath holes respectively sleeve the support mandrels;

a first elastic part in the main tube and having a first through hole, wherein the first elastic part is disposed between the two support mandrels to sleeve the two support mandrels and against the baffle plates of the two support mandrels; and a second elastic part and a third elastic part in the main tube and respectively having a second through hole and a third through hole, wherein the second and the third though holes are respectively sleeved the two support mandrels, and the second and the third elastic parts are respectively disposed between and against the baffle plates of the support mandrels and the sheath covers.

The earthquake resistant and reinforcing device as above mentioned further comprises two connecting parts, wherein each of the two connecting parts has a pivotal connection part disposed on one end thereof to be pivotally assembled with the assembling parts of the support mandrels, and the other end of the connecting part is fastened on a pedestal.

The earthquake resistant and reinforcing device as above mentioned, wherein each of the pivotal connection parts of the connecting parts has two lugs disposed at a distance, two pivotal holes are respectively disposed on each of the two lugs, the assembling parts of the support mandrels each is disposed between the lugs, and the assembling parts each has a pivotal hole corresponding to the pivotal holes of the lugs for receiving a pivot penetrating the pivotal holes of the support mandrels and the lugs to pivotally connect the support mandrels and the pivotal connection parts of the connecting parts.

The earthquake resistant and reinforcing device as above mentioned, wherein an outer wall at two ends of the main tube has external thread sections, and the inner walls of the main tube sheath holes respectively have corresponding inner thread sections to match the external thread sections of the main tube.

The earthquake resistant and reinforcing device as above mentioned further comprises at least one sealing ring embedded in each of the support mandrel sheath holes and tightly contacts walls of the support mandrels.

The earthquake resistant and reinforcing device as above mentioned, wherein the sheath covers each comprises a main tube assembling part and a support mandrel assembling part, a diameter of the support mandrel assembling part is smaller than a diameter of the main tube assembling parts, so that the main tube sheath holes are formed by the main tube assembling parts and the support mandrel sheath holes are formed by the support mandrel assembling parts.

The earthquake resistant and reinforcing device as above mentioned, wherein the assembling parts of the support mandrels are formed as rods and have an angle between the assembling parts and the support mandrels.

The earthquake resistant and reinforcing device as above mentioned, wherein the angle is 45° between the assembling parts and the support mandrels.

The earthquake resistant and reinforcing device as above mentioned further comprises two extending tubes disposed on two ends of the assembling parts in a rod shape.

The earthquake resistant and reinforcing device as above mentioned further comprises soft covers for wrapping the support mandrels between the sheath covers and the assembling parts of the support mandrels.

Thereby this device can be installed between beams and columns of buildings and bridges. When the beam and the column have relative movements, the actions of the relative movements are transferred to the two support mandrels through the assembling parts to drive the two support mandrels to generate relative movements relative to the main tube. The first elastic part, the second elastic part, and the third elastic part in the main tube can provide an elastic damping force and support to effectively absorb and eliminate the energy waves acting on the beam and the column. Therefore, the safety of buildings and bridges in earthquakes can be increased.

DETAILED DESCRIPTION

Figure 1:
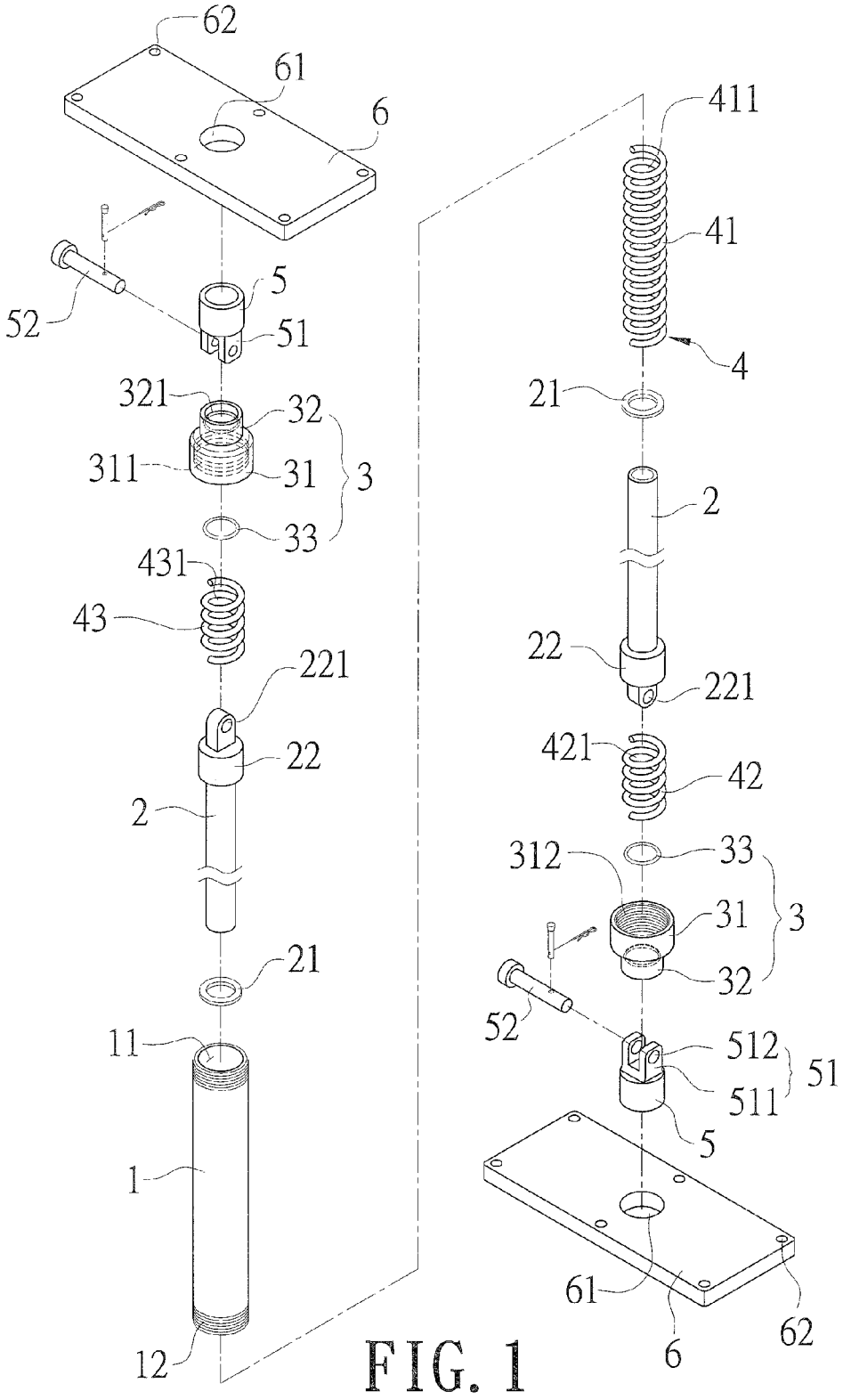
FIG. 1 is a perspective exploded diagram of an embodiment in this invention.
Figure 2:
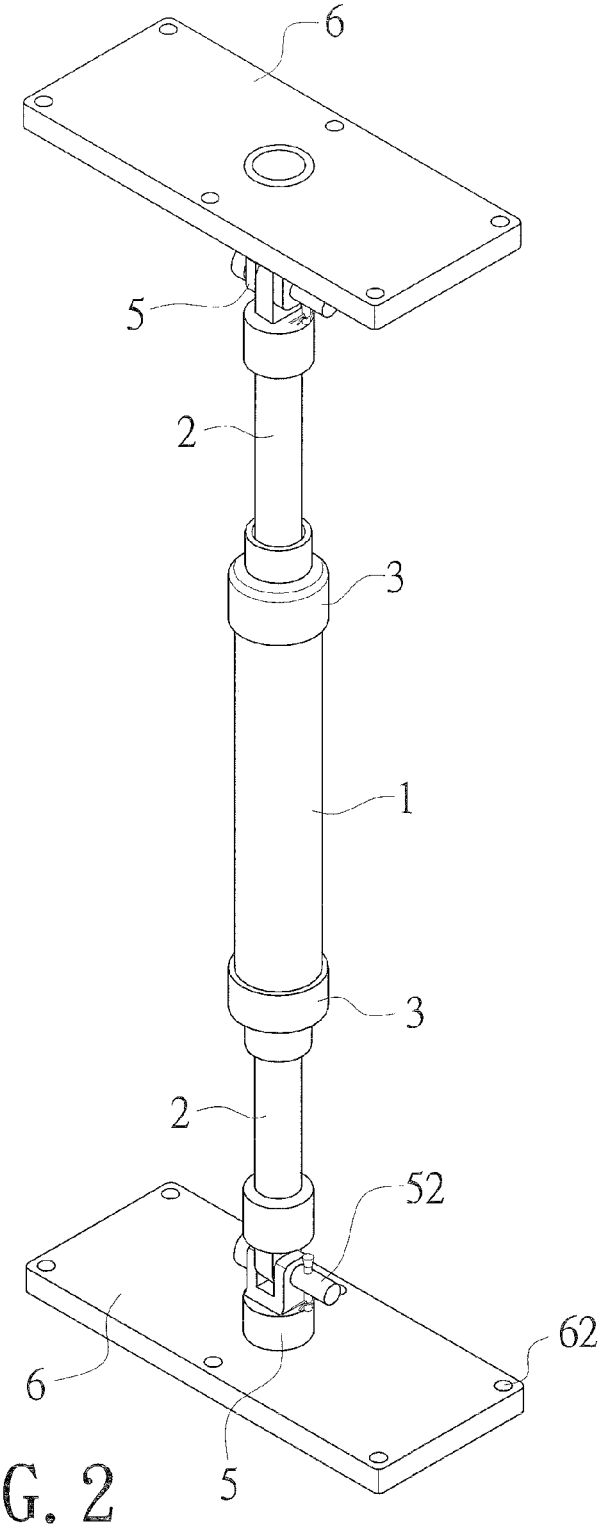
FIG. 2 is a perspective diagram of an embodiment in this invention.
Figure 3:
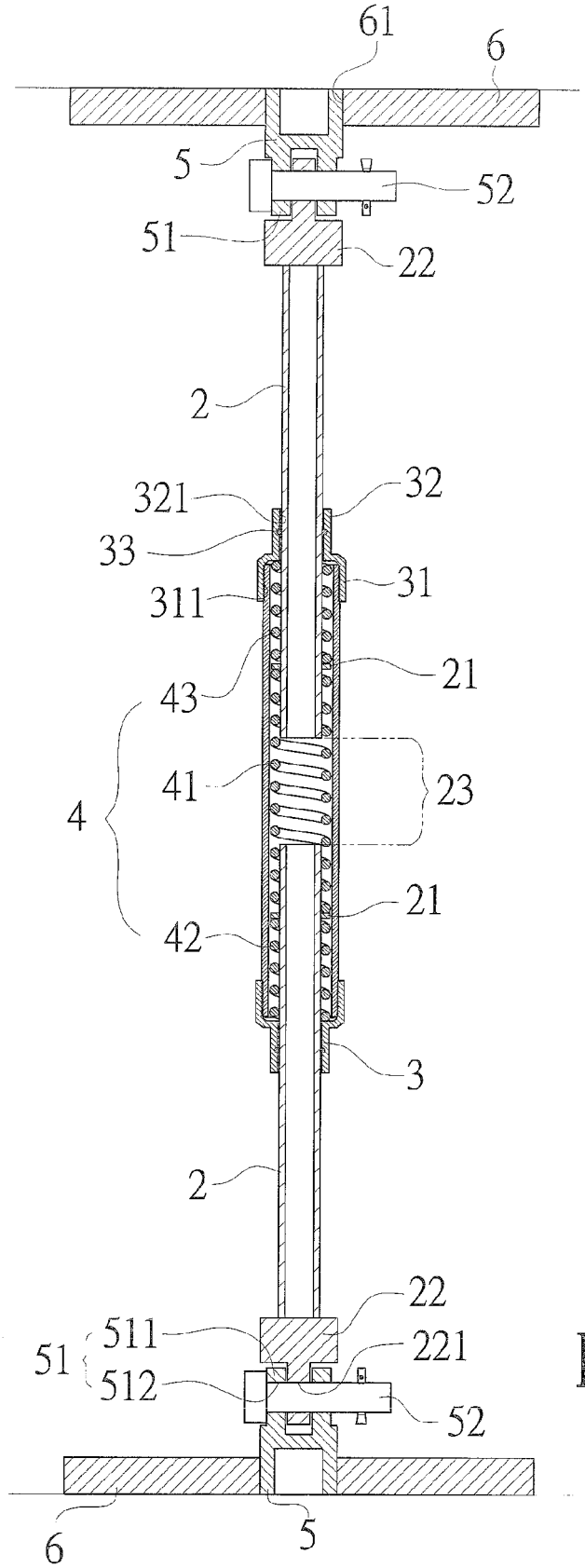
FIG. 3 is a cross-sectional diagram of an embodiment in this invention.

First, please refer to FIGS. 1-3, which show the earthquake resistant and reinforcing device for buildings and bridges according an embodiment of this invention. This device comprises a main tube 1, two support mandrels 2, two sheath covers 3, several elastic parts 4, two connecting parts 5, and two pedestals 6.

In the main tube 1, a tubular hole 11 penetrates the main tube 1 through the central thereof, and two external thread sections 12 are located at two ends of the outer wall of the main tube 1.

In each of the support mandrels 2, a baffle plate 21 is disposed at one end of the support mandrel 2. The ends of the two support mandrels 2 near the baffle plates 21 together with the baffle plates 21 are inserted into the tubular hole 11 of the main tube 1, and a space 23 is formed between the two support mandrels 2 inside the tubular hole 11 of the main tube 1. Two assembling parts 22 are respectively disposed on the other ends of the two support mandrels 2 outside the tubular hole 11 of the main tube 1 and respectively have a pivotal hole 221.

In each of the sheath cover 3, a main tube assembling part 31 and a support mandrel assembling part 32 are sequentially formed on the sheath cover 3. The diameter of the support mandrel assembling parts 32 are smaller than the diameter of the main tube assembling parts 31, so that main tube sheath holes 311 formed by the main tube assembling parts 31 and support mandrel sheath holes 321 formed by the support mandrel assembling part 32 have different hole diameters respectively corresponding to the diameters of the main tube 1 and the support mandrels 2. Two inner thread sections 312 are respectively formed on the inner walls of the two main tube sheath holes 311. At least one sealing ring 33 is embedded in each of the support mandrel sheath holes 321. The main tube sheath holes 311 of the two sheath cover 3 respectively sleeve the two ends of the main tube 1 to match the inner thread sections 312 of the sheath cover 3 and the external thread sections 12 of the main tube 1. The support mandrel sheath holes 321 of the two sheath covers 3 also respectively sleeve the two support mandrels 2, and the sealing rings 33 tightly contact the walls of the support mandrels 2.

The elastic parts 4 comprise a first elastic part 41, a second elastic part 42, and a third elastic part 43, which are springs to form through holes 411, 421, and 431. The first elastic part 41, the second elastic part 42 and the third elastic part 43 are accommodated in the tubular hole 11 of the main tube 1. The first elastic part 41 is disposed between the two support mandrels 2, and the through hole 411 of the first elastic part 41 sleeves the two ends of the two support mandrels 2 in the tubular hole 11 of the main tube 1, so that the two ends of the first elastic part 41 are positioned by respectively against the two baffle plates 21 of the two support mandrels 2. The through hole 421 of the second elastic part 42 and the through hole 431 of the third elastic part 43 are respectively sleeved with the two support mandrels 2. The second elastic part 42 and the third elastic part 43 are respectively disposed between the two sheath covers 3 and the two baffle plates 21 of the two support mandrels 2. Therefore, the two ends of the second elastic part 42 and the third elastic part 43 are positioned by respectively against the sheath covers 3 and the baffle plates 21 of the support mandrels 2.

In each of the connecting parts 5, a pivotal connection part 51 disposed at one end of the connecting part 5, and two lugs 511 are disposed on the pivotal connection part 51 at a distance. In addition, pivotal holes 512 are respectively disposed on each of the lugs 511. The assembling parts 22 of the support mandrels 2 are respectively disposed between the lugs 511 of the pivotal connection parts 51 of the two connecting parts 5, so that the pivotal holes 221 of the assembling parts 22 of the support mandrels 2 can align with the pivotal holes 512 of the lugs 511. Two pivots 52 respectively penetrate through the pivotal holes 221 of the support mandrels 2 and the pivotal holes 512 of the lugs 511 to pivotally connect the support mandrels 2 and the pivotal connection parts 51 of the connecting parts 5.

In each of the pedestals 6, a connecting hole 61 is disposed in the center of the pedestals 6 and welded to fix the other end of the connecting part 5 opposite to the pivotal connection part 51. In addition, several locking holes 62 are disposed on the pedestals 6.

Figure 4:
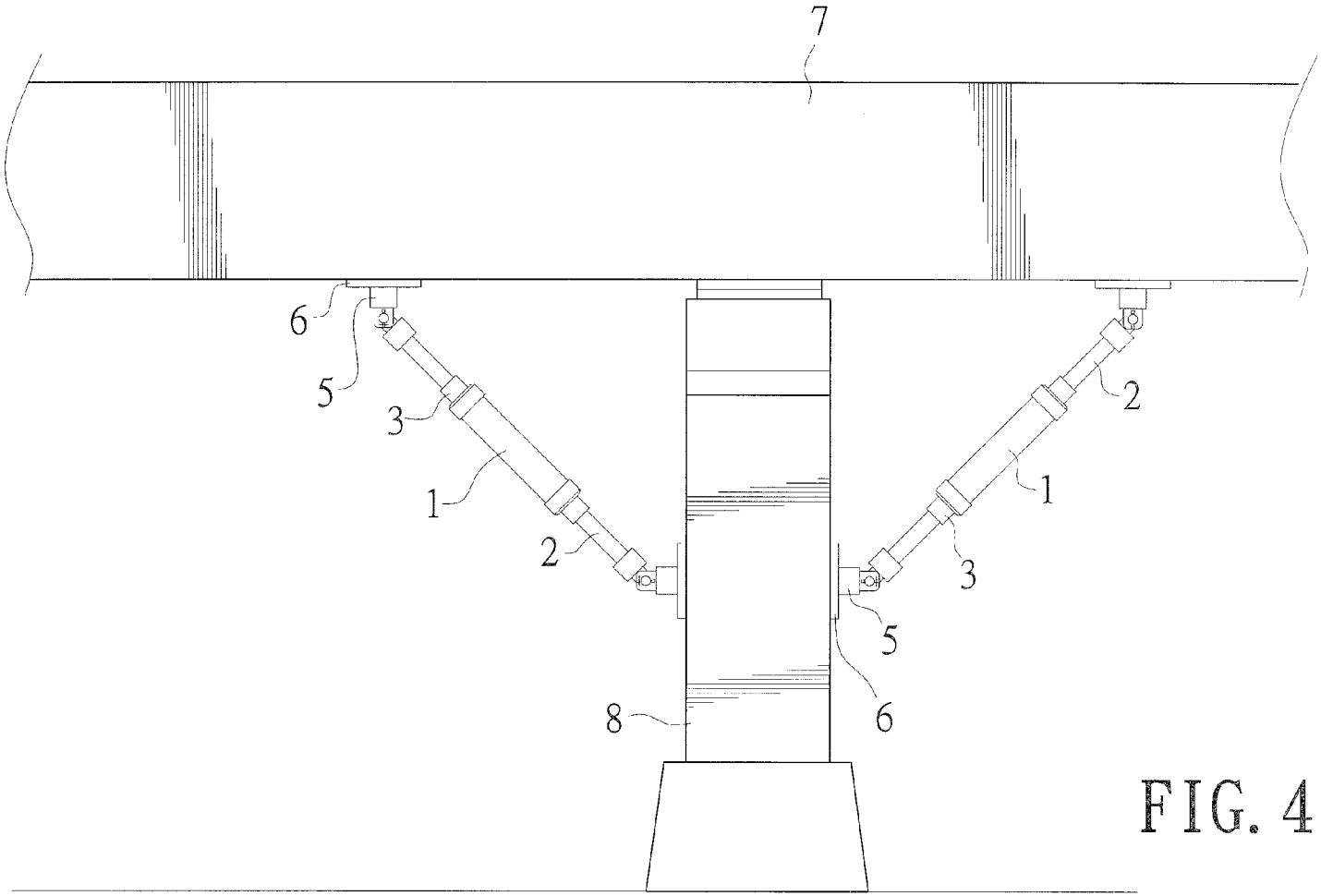
FIG. 4 is a front view of a state installed between a beam and a column according to an embodiment in this invention.
Figure 5:
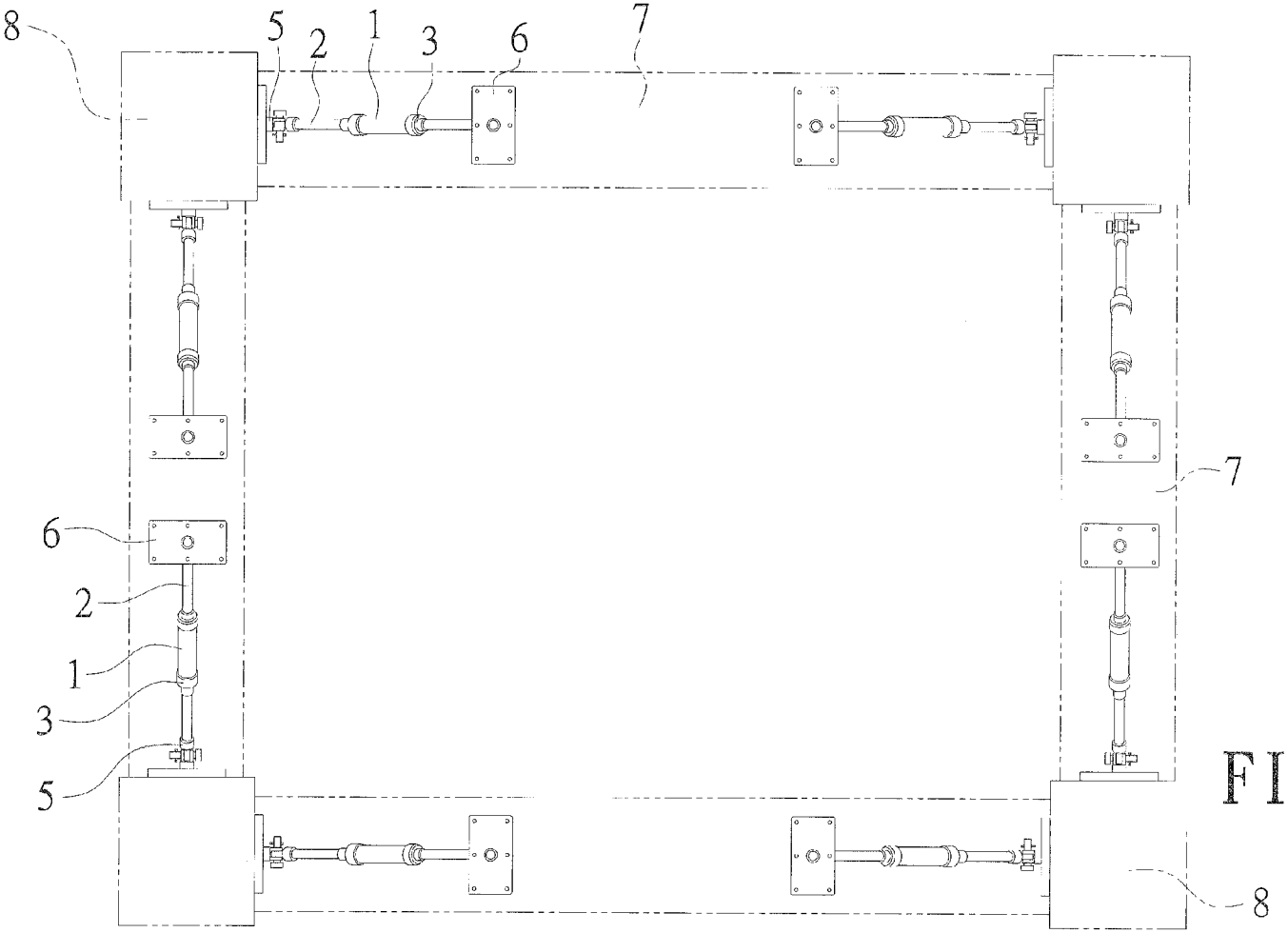
FIG. 5 is a top view of a state installed between a beam and a column according to an embodiment in this invention.
Figure 6:
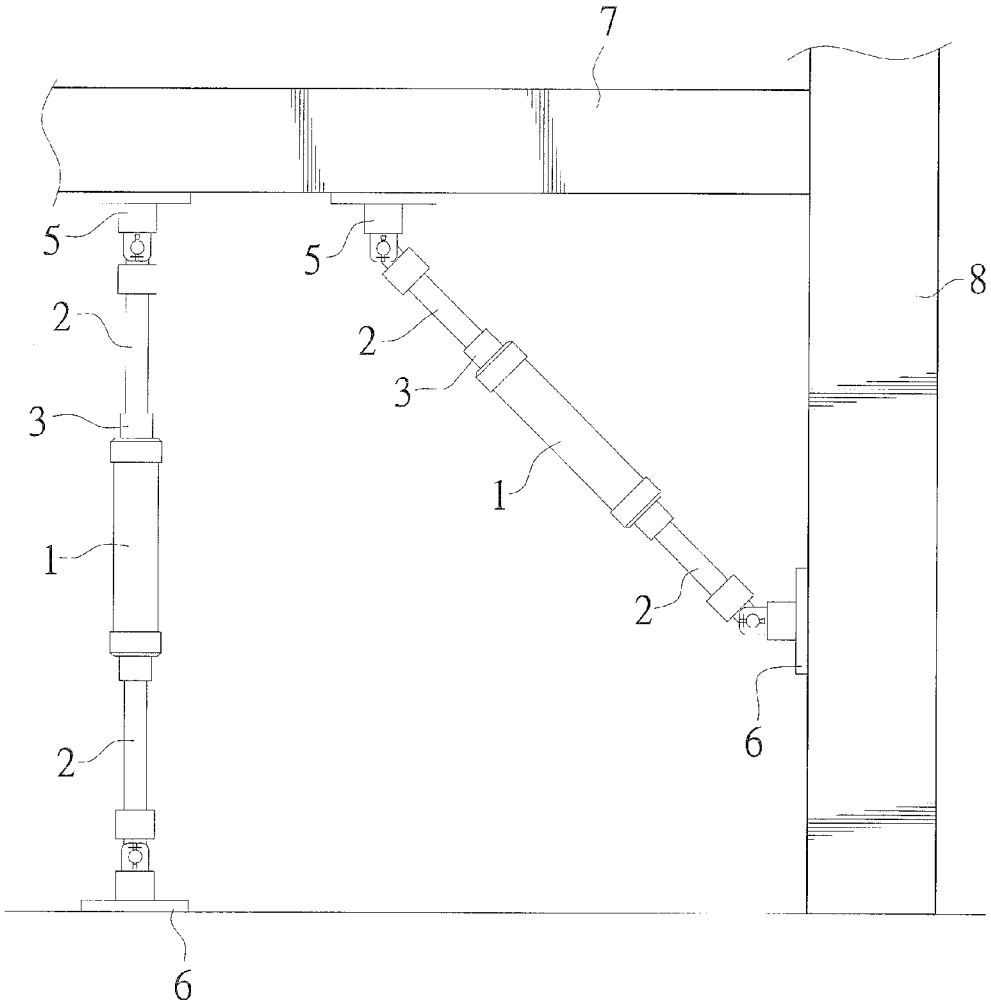
FIG. 6 is a front view of a state installed between a beam and a floor according to an embodiment in this invention.

Please also refer to FIGS. 4-6. Accordingly, the device above can be installed between a beam 7 and a column 8 (shown in FIGS. 7 and 8), between a beam 7 and a floor (shown in FIG. 6), and/or between a column 8 and a wall of a building or a bridge. More specifically, the two pedestals 6 can be respectively against the beam 7 and the column 8 (FIGS. 4-5), one against the beam 7 and the other against the floor (FIG. 6), or one against the column 8 and the other against the wall. Locking parts, such as screws or rivets, can be used to penetrate the locking holes 62 of the pedestals 6 to respectively lock the pedestals 6 on to the beam 7 and the column 8, the beam 7 and the floor, or the column 8 and the wall. The main tube 1 and the support mandrels 2 are installed in an angle of 45° between the beam 7 and the column 8 (FIGS. 4-5), vertically between the beam 7 and the floor (FIG. 6), or horizontally between the column 8 and the wall to form an earthquake resistant structure in a diamond shape. The design of tightly contacting the support mandrels 2 by the sealing rings 33 of the sheath covers 3 can prevent rain from penetrating the inner side of the main tube 1, so that the elastic part 4 won't get rusty to be disabled.

Accordingly, when an earthquake occurs, the beam 7 and the column 8 will have relative movements caused by the shaking of the buildings or bridges. The interactions will be transferred to the two pedestals 6 of the earthquake resistant device of this invention, and then drive the two support mandrels 2 to actively stretch relative to the main tube 1. When the two support mandrels 2 are compressed and move into the space 23 between the two support mandrels 2 inside the main tube 1, the first elastic part 41 will be compressed by the two support mandrels 2, and the first elastic part 41 can offers an elastic damping force to the two support mandrels 2. Thus, the energy waves transferred form the two support mandrels 2 to the main tube 1 can be absorbed. When the two support mandrels 2 are extended out from the main tube 1, the second elastic part 42 and the third elastic part 43 will be compressed. Therefore, the second elastic part 42 and the third elastic part 43 provide an elastic damping force to the two support mandrels 2 extending outward. Hence, the energy wave transferred form the two support mandrels 2 to the main tube 1 can be absorbed and thus eliminated. Accordingly, the first elastic part 41, the second elastic part 42, and the third elastic part 43 can offer elastic damping force at proper times when an earthquake occurs. Therefore, the energy waves acting on the beam 7 and the column 8 of buildings and bridges can be effectively absorbed and eliminated to decrease the damage caused by the energy waves to the beam 7 and the column 8 of buildings and bridges. Thus, the structural integrity of the beam 7 and the column 8 of buildings and bridges can be maintained to increase the safety of the buildings and bridges.

Figure 7:
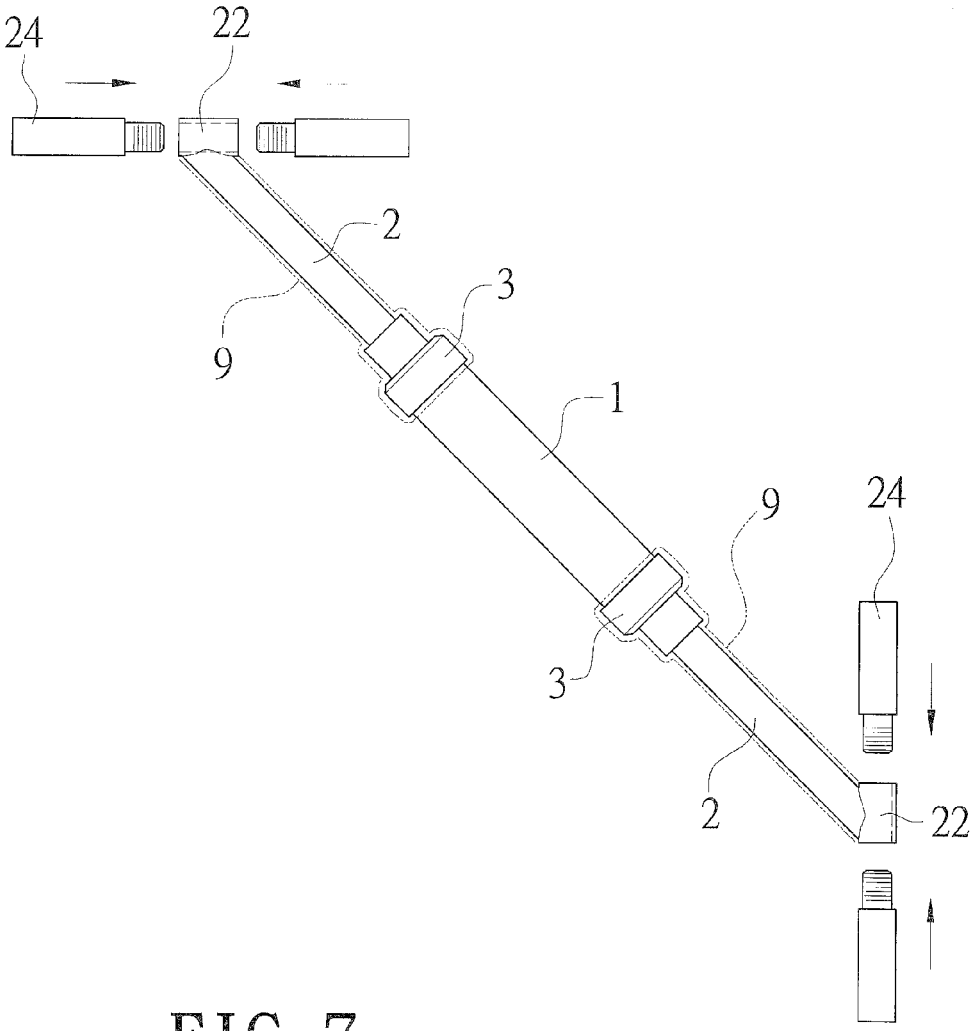
FIG. 7 is a front exploded diagram of another embodiment in this invention.
Figure 8:
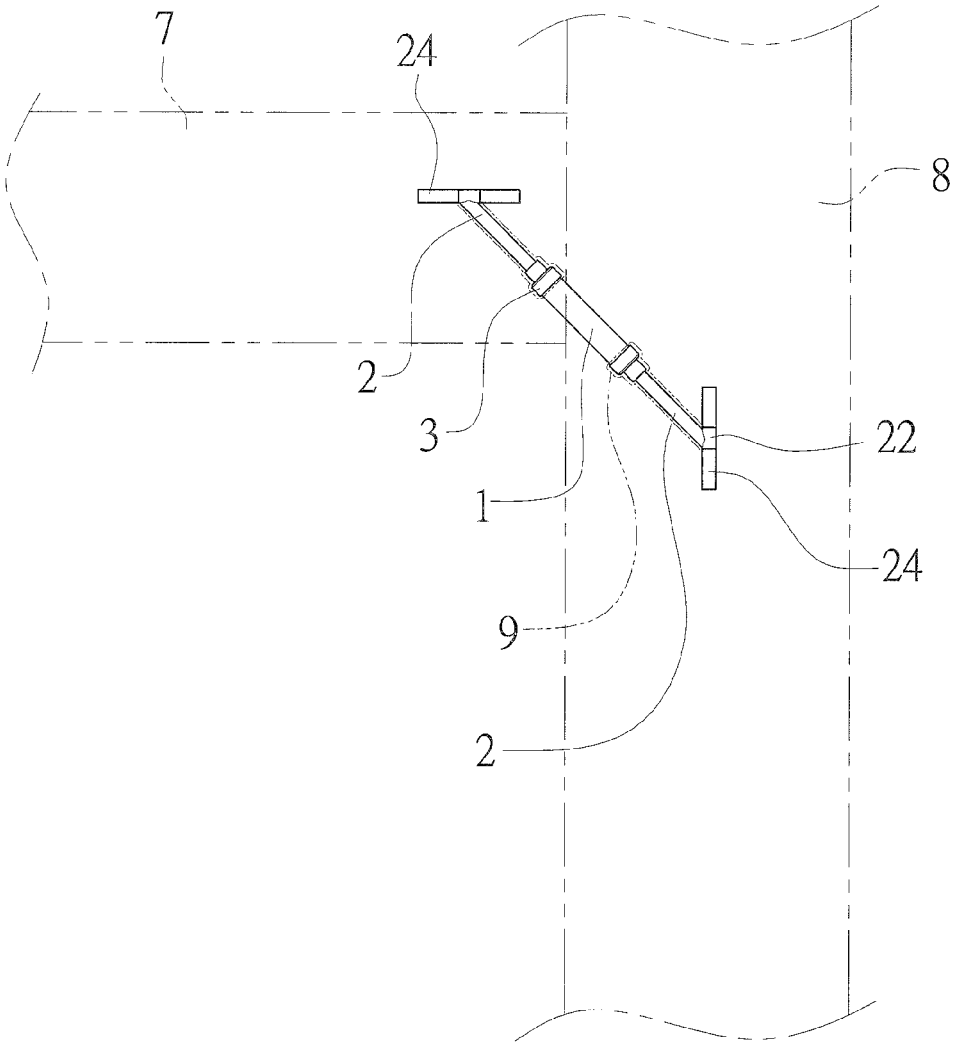
FIG. 8 is a front diagram of a state installed between a beam and a column according to another embodiment in this invention.

Please refer to FIGS. 7 and 8, which show another earthquake resistant and reinforcing device for buildings and bridges according to another embodiment. In this embodiment, the assembling parts 22 of the support mandrels 2 are formed as rods and have an angle of 45° with the support mandrels 2. Additional extending tubes 24 are disposed on and sleeved two ends of the assembling part 22. The extending tubes 24 and the assembling part 22 can be assembled by screws. Therefore, soft covers 9 are respectively wrap the parts between the sheath covers 3 on two ends of the main tube 1 and the assembling parts 22 of the support mandrels 2. The soft covers 9 may be made from a foam, a film, or a cushion. The earthquake resistant and reinforcing device above may be disposed between the beam 7 and the column 8 of buildings and bridges, and the two assembling parts 22 and the extending tubes 24 are against the terminal surfaces of the beam 7 and the column 8 to install the device between the beam 7 and the column 8 in an angle of 45°. Subsequently, cement is laid on the outer side of the earthquake resistant and reinforcing device to bury the device in the wall. Since the two support mandrels 2 are wrapped by the soft covers 9, the two support mandrels 2 still can actively stretch relative to the main tube 1. Therefore, when the beam 7 and the column 8 have relative movements, the actions of the relative movements are transferred to the two support mandrels 2 through the assembling parts 22 to drive the two support mandrels 2 to generate relative movements relative to the main tube 1. The first elastic part 41, the second elastic part 42, and the third elastic part 43 in the main tube 1 can provide an elastic damping force and support to effectively absorb and eliminate the energy waves acting on the beam 7 and the column 8. Hence, the beam 7 and the column 8 will not be crushingly damaged to maintain the structural safety of buildings and bridges.

What is claimed is:

1. An earthquake resistant and reinforcing device for buildings and bridges, comprising:

a main tube having a tubular hole penetrating a central portion of the main tube;

two support mandrels each having a baffle plate disposed at one end of the support mandrel in the tubular hole of the main tube and an assembling part on another end of the support mandrel outside the main tube, wherein a space is disposed between the two support mandrels;

two sheath covers each having a main tube sheath hole corresponding to a diameter of the main tube and a support mandrel sheath hole corresponding to a diameter of the support mandrels, the main tube sheath holes being thereby sleeved onto two ends of the main tube and the support mandrel sheath holes being respectively sleeved onto the support mandrels;

a first elastic part disposed in the main tube and defining a first through hole, wherein the first elastic part is disposed between the two support mandrels, the baffle plates being respectively sleeved onto the two support mandrels; and a second elastic part and a third elastic part disposed in the main tube and respectively defining a second through hole and a third through hole, wherein respective portions of the two support mandrels located within the tubular hole pass through the second and the third through holes, and the second and the third elastic parts are respectively disposed between and against the baffle plates of the support mandrels and the sheath covers.

2. The earthquake resistant and reinforcing device of claim 1, further comprising two connecting parts, wherein each of the two connecting parts has a pivotal connection part disposed on one end thereof to be pivotally assembled with the assembling parts of the support mandrels, and the other end of the connecting part is fastened on a pedestal.

3. The earthquake resistant and reinforcing device of claim 2, wherein each of the pivotal connection parts of the connecting parts has two lugs disposed at a distance, two pivotal holes are respectively disposed on each of the two lugs, the assembling parts of the support mandrels each is disposed between the lugs, and the assembling parts each has a pivotal hole corresponding to the pivotal holes of the lugs for receiving a pivot penetrating the pivotal holes of the support mandrels and the lugs to pivotally connect the support mandrels and the pivotal connection parts of the connecting parts.

4. The earthquake resistant and reinforcing device of claim 1, wherein an outer wall at two ends of the main tube has external thread sections, and inner walls of the main tube sheath holes respectively have corresponding inner thread sections to match the external thread sections of the main tube.

5. The earthquake resistant and reinforcing device of claim 1, further comprising at least one sealing ring embedded in each of the support mandrel sheath holes and tightly contacts walls of the support mandrels.

6. The earthquake resistant and reinforcing device of claim 1, wherein the sheath covers each comprises a main tube assembling part and a support mandrel assembling part, a diameter of the support mandrel assembling part is smaller than a diameter of the main tube assembling parts, so that the main tube sheath holes are formed by the main tube assembling parts and the support mandrel sheath holes are formed by the support mandrel assembling parts.

7. The earthquake resistant and reinforcing device of claim 1, wherein the assembling parts of the support mandrels are formed as rods and have an angle between the assembling parts and the support mandrels.

8. The earthquake resistant and reinforcing device of claim 7, wherein the angle is 45° between the assembling parts and the support mandrels.

9. The earthquake resistant and reinforcing device of claim 7, further comprising two extending tubes disposed on two ends of the assembling parts in a rod shape.

10. The earthquake resistant and reinforcing device of claim 7, further comprising soft covers for wrapping the support mandrels between the sheath covers and the assembling parts of the support mandrels.

* * * * *